United States Patent [19]

Montagu

[11] Patent Number: 4,528,533

[45] Date of Patent: Jul. 9, 1985

[54] ACTUATOR WITH COMPENSATING FLUX PATH

[75] Inventor: Jean I. Montagu, Brookline, Mass.

[73] Assignee: General Scanning, Inc., Watertown, Mass.

[21] Appl. No.: 633,900

[22] Filed: Jul. 24, 1984

Related U.S. Application Data

[63] Continuation-in-part of Ser. No. 402,432, Jul. 28, 1982.

[51] Int. Cl.[3] ..... H01F 7/08

[52] U.S. Cl. ..... 335/230; 335/272; 310/49 R

[58] Field of Search ..... 335/229, 230, 232, 234, 335/272, 279; 310/49

[56] References Cited

U.S. PATENT DOCUMENTS

| | | | |
|---|---|---|---|
| Re. 26,749 | 1/1970 | Montagu | 335/229 |
| Re. 31,062 | 10/1982 | Burke, Jr. | 335/229 |
| 2,364,656 | 12/1944 | Price | 175/336 |
| 3,177,385 | 4/1965 | Montagu | 310/15 |
| 3,329,916 | 7/1967 | Carson | 335/230 |
| 3,343,012 | 9/1967 | Scott | 310/36 |
| 3,624,574 | 11/1971 | Montagu | 335/230 |
| 3,753,180 | 9/1973 | Sommer | 335/272 |
| 3,959,673 | 5/1976 | Montagu | 310/38 |
| 3,970,979 | 7/1976 | Montagu | 335/229 |
| 4,103,191 | 7/1978 | Kawamura et al. | 310/49 R |
| 4,110,879 | 9/1978 | Burke, Jr. | 29/25.42 |
| 4,142,144 | 2/1979 | Rohr | 324/61 R |
| 4,186,332 | 1/1980 | Montagu | 318/128 |

OTHER PUBLICATIONS

Mizoshita et al., "Mechanical and Servo Design of a 10 inch Disk Drive", IEEE Transactions on Magnetics, vol. MAG-17, No. 4, Jul., 1981, pp. 1387-1391.

Winfrey et al., "Design of a High Performance Rotary Positioner for a Magnetic Disk Memory", IEEE Transactions on Magnetics, vol. MAG-17, No. 4, Jul., 1981, pp. 1392-1395.

*Primary Examiner*—George Harris

[57] ABSTRACT

In an actuator having a stator assembly which defines a pair of stator pole faces, a permeable rotor assembly which is positioned to rotate relative to the stator assembly, and which defines a driving pole face separated from each of the stator pole faces by a flux permeable driving gap, the rotor assembly having an operational range of rotor angular positions over which drive flux passing across the driving gap drives the rotor assembly, the extent of the driving gap at one of the stator pole faces being reduced as the rotor assembly rotates toward the limit of the operational range, the improvement including a flux-permeable compensating gap between the driving pole face and each stator pole face which provides a secondary path for drive flux as the rotor assembly rotates toward the limit of the operational range, the compensating gap being less permeable than the driving gap.

16 Claims, 17 Drawing Figures

FIG 7
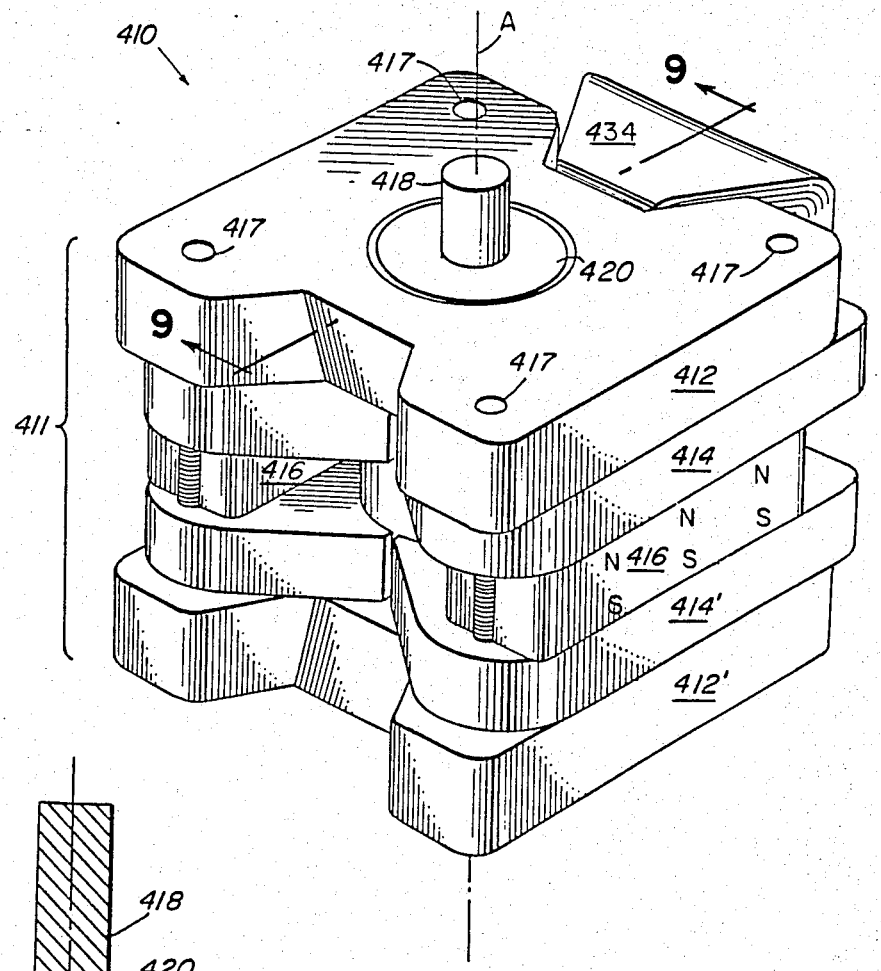
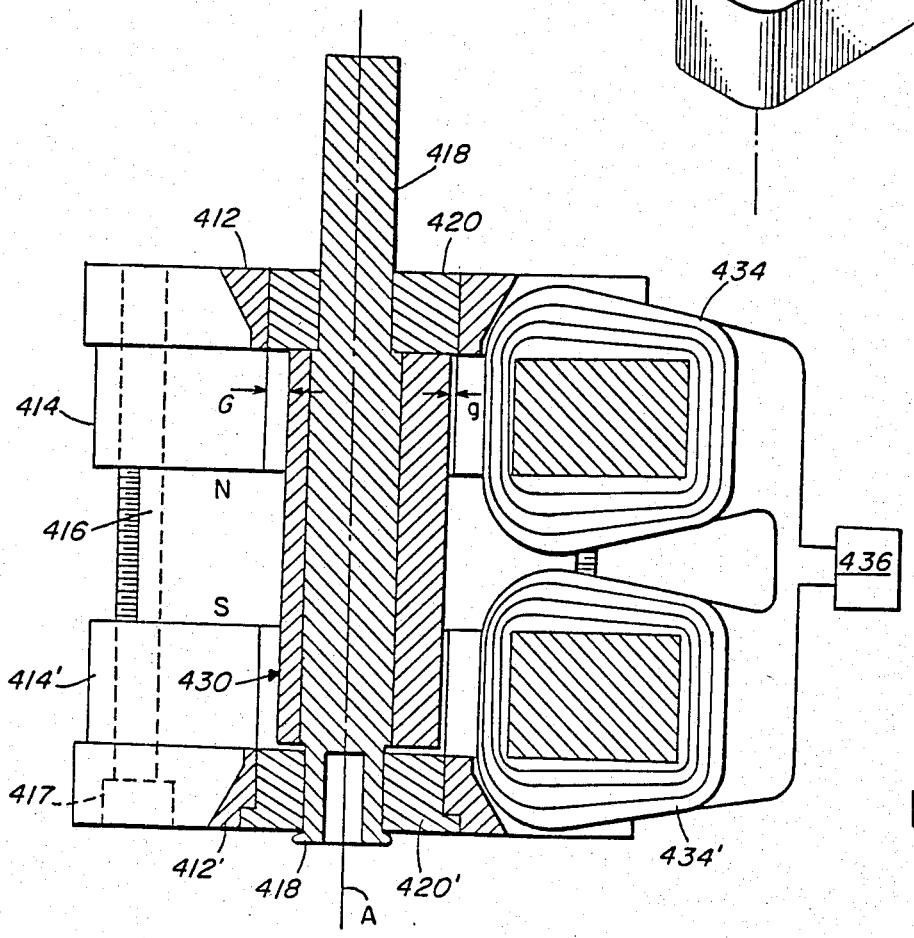
FIG 9

ACTUATOR WITH COMPENSATING FLUX PATH

BACKGROUND OF THE INVENTION

This application is a continuation-in-part of copending U.S. patent application Ser. No. 402,432, filed July 28, 1982, and assigned to the same assignee as this application.

This invention relates to limited rotation electromechanical actuators that have so-called moving iron rotors.

In typical such actuators, a permeable rotor assembly defines rotor pole faces and is mounted to rotate relative to a stator assembly. The stator assembly has a pair of pole pieces (each having a pair of stator pole faces arranged around the rotor axis) and one or two permanent magnets which impose biasing flux through the pole pieces and the rotor assembly via corresponding pairs of the rotor and stator pole faces.

Usually each rotor pole face and the corresponding stator pole faces are segments of circles defining a constant gap g which is crossed both by the biasing flux and by a variable drive flux imposed by a drive coil on the stator assembly.

It is known that at large angular excursions and for large drive currents, drive torque falls off from a true linear relationship with drive current.

In low-speed moving iron actuators of the kind in which the drive torque is resisted by a mechanical spring, the torque nonlinearity results in a nonlinearity of equilibrium rotor position with drive current. Montagu, U.S. Pat. No. 3,624,574, discloses compensating for the nonlinearity by slotting the rotor to reduce the arc length of a region of the rotor pole face. When the rotor reaches wide angular excursions, the reduced pole face region no longer overlaps both stator pole faces and is attracted by means of the permanent magnet biasing flux to the one stator pole face which it continues to overlap. This attraction is intended to offset the positional nonlinearity. Montagu, U.S. Pat. No. 3,624,574, discloses shaving the rotor pole face corners to accomplish essentially the same result.

For medium-speed motion requiring medium torques (and hence medium drive coil currents), it has been thought that the nonlinearity of motion resulting from the nonlinearity of torque can best be compensated by feedback circuits based on measurements of the rotor angular velocity, as disclosed in Montagu, U.S. Pat. Nos. 4,186,332, and 3,970,979. Such closed-loop servo systems, however, exhibit instability in high-speed operation, especially at wide angular positions, and therefore are not suitable for high speed applications requiring high positional accuracy.

Thus, provisions to compensate for nonlinearities of limited rotation actuators have been costly and a ceiling of performance has been reached beyond which such actuators have not appeared to have useful application.

SUMMARY OF THE INVENTION

In general, the invention features an improvement in the construction of the actuator which reduces the inherent nonlinearity by providing a flux-permeable compensating gap between the driving pole face and each stator pole face which provides the secondary flux path as the rotor assembly rotates toward the limit of its operational range, the compensating gap being less permeable than the driving gap.

In another aspect the invention features a rotor assembly which, in addition to a main rotor pole face separated from the stator pole faces by a uniform gap g, defines secondary pole face regions adjacent either end of the main pole face, the secondary regions being separated from the stator pole faces by uniform compensating gaps G, where G is greater than, but no more than about 15 times greater than g.

In preferred embodiments, the compensating gap at each stator pole face increases in extent as the driving gap at that stator pole face decreases, and vice versa; the rotor assembly defines a rotor pole face which is separated from the two stator pole faces respectively by first and second driving gaps, and is arranged to define variable first and second pole face regions which overlap and cooperate respectively with the two stator pole faces, the areas of the two regions being dependent on the angular position of the rotor assembly, the areas being reduced respectively at the opposite limits of the operational range, a drive means is associated with the stator assembly and is arranged to impose a variable magnetic driving flux along a path which passes through one stator pole face, across the first driving gap, through the first region of the rotor pole face, through the second region of the rotor pole face, and through the other stator pole face, and the rotor assembly further defines secondary pole face regions separated from the two stator pole faces by the compensating gap and arranged to overlap and cooperate with the first and second stator pole faces to provide the secondary path for the magnetic driving flux to pass between the rotor assembly and at least one of the stator pole faces; there are third and fourth stator pole faces and an additional rotor pole face separated from the third and fourth stator pole faces by third and fourth flux-permeable driving gaps, and the rotor assembly further defines variable third and fourth pole face regions separated from the third and fourth stator pole faces by an additional flux-permeable compensating gap and arranged to overlap and cooperate with the third and fourth stator pole faces to provide an additional secondary path for the magnetic driving flux; the pole faces are cylindrical; the stator pole faces have the same radius, the pole face regions have the same radius, and the secondary pole face regions have the same radius; the driving gaps are uniform and equal to g, and the compensating gaps are uniform and equal to G, which is between about 4 and about 15 times (preferably between 7 and 8 times) greater than g; the first and second stator pole faces and the secondary pole face regions are contoured to provide a selectable relationship between drive current and rotor torque; g is about 0.004 inches and G is about 0.040 inches; and the extent of each rotor pole face region is of the same order as the extent of each stator pole face.

An important feature of the invention is an optical reader for computer memory, and the like, comprising the combination of a compensated actuator as described above with an optical storage medium, an optical element for sensing information stored on the medium, and an arm for supporting the optical element, the arm being connected at a point spaced from the optical element to the rotor assembly, whereby the drive means causes the optical element to move with high speed and accuracy to selectable positions with reference to the optical medium.

In other embodiments, the rotor assembly defines a pair of rotor pole faces spaced apart along the rotational axis and permeably connected by a flux path having an axial component through the rotor assembly, and each rotor and stator pole face subtends an angle of between about 90° and about 180° around the axis; each rotor pole face subtends an angle of approximately 180°; and each stator pole face subtends an angle between about 120° and about 160°.

The compensating rotor pole face regions provide a second path for flux. Ths alternate path reduces the choking-off of drive flux when the rotor is turned to its point of maximum angular excursion. The rotor torque demonstrates improved linearity with respect to angular position and current. Contouring the compensating pole faces can provide other desired torque characteristics.

Other advantages and features of the invention will become apparent from the following description of the preferred embodiments, and from the claims.

DESCRIPTION OF PREFERRED EMBODIMENTS

We first briefly describe the drawings.

DRAWINGS

Figure 1:
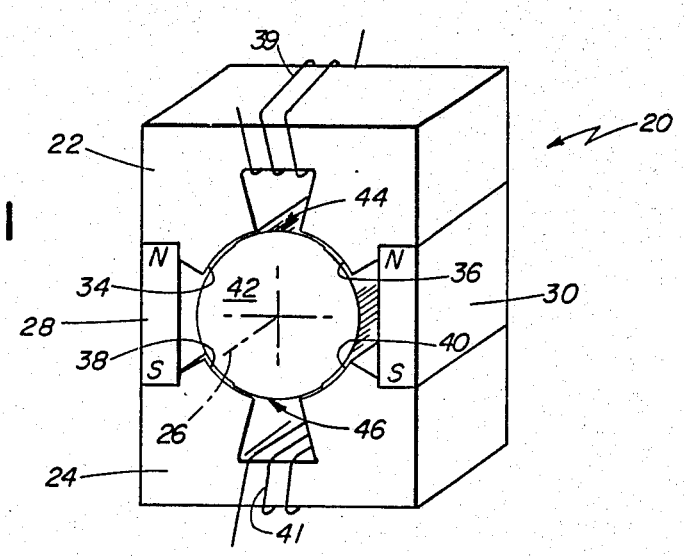
FIG. 1 is an isometric view of a preferred embodiment of the actuator.
Figure 4:
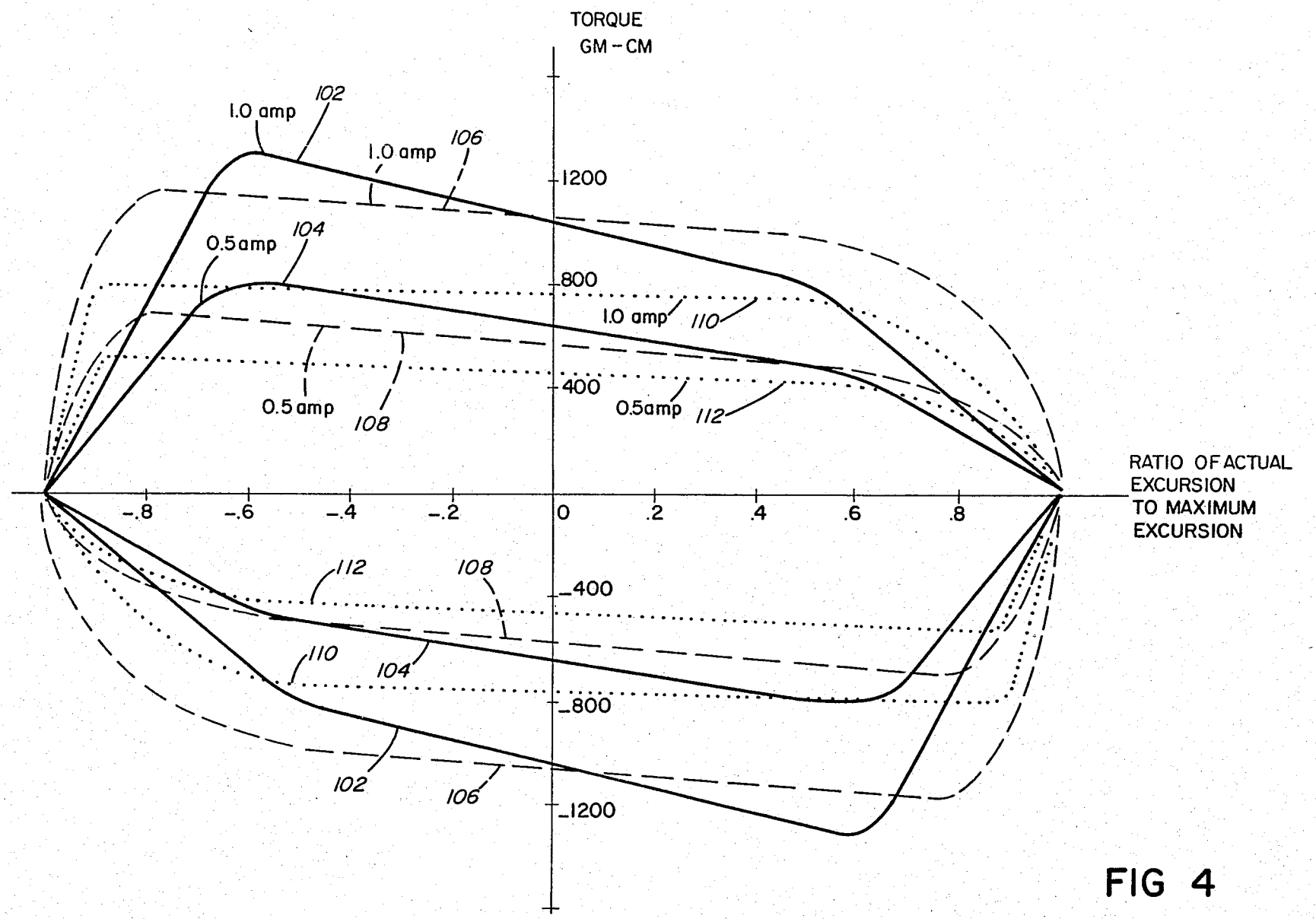

FIG. 4 graphs torque against angular position for different drive currents for the actuator of FIG. 1 and for a conventional actuator.

Figure 5:
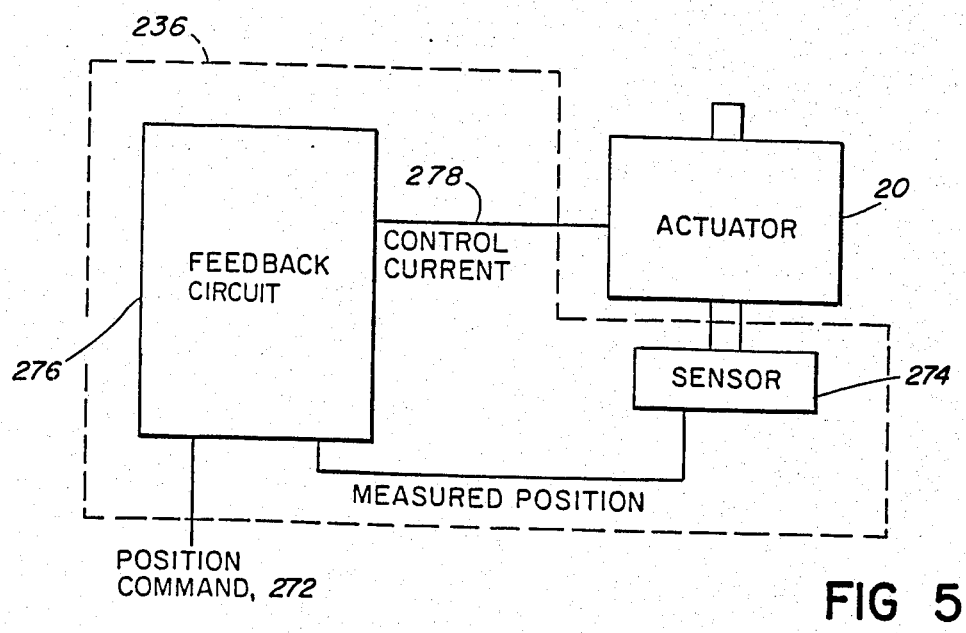

FIG. 5 is a block diagram of a feedback-driven, controlled-current source for the actuator.

Figure 6:
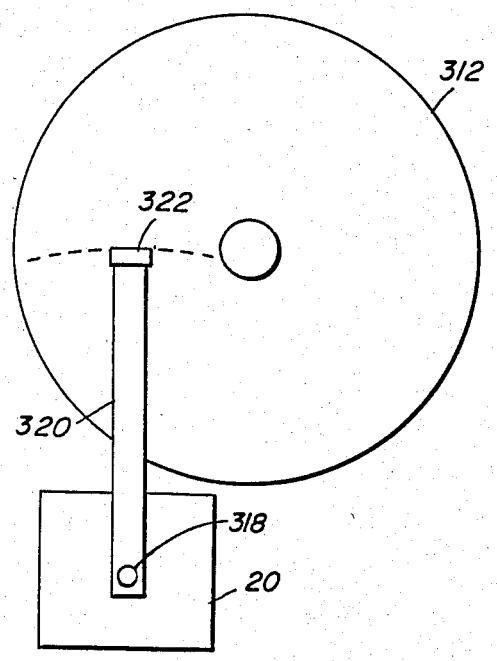

FIG. 6 is a top view of an optical disk scanner using the actuator of FIG. 1.

FIG. 7 is an isometric view of another embodiment of the actuator.

Figure 8:
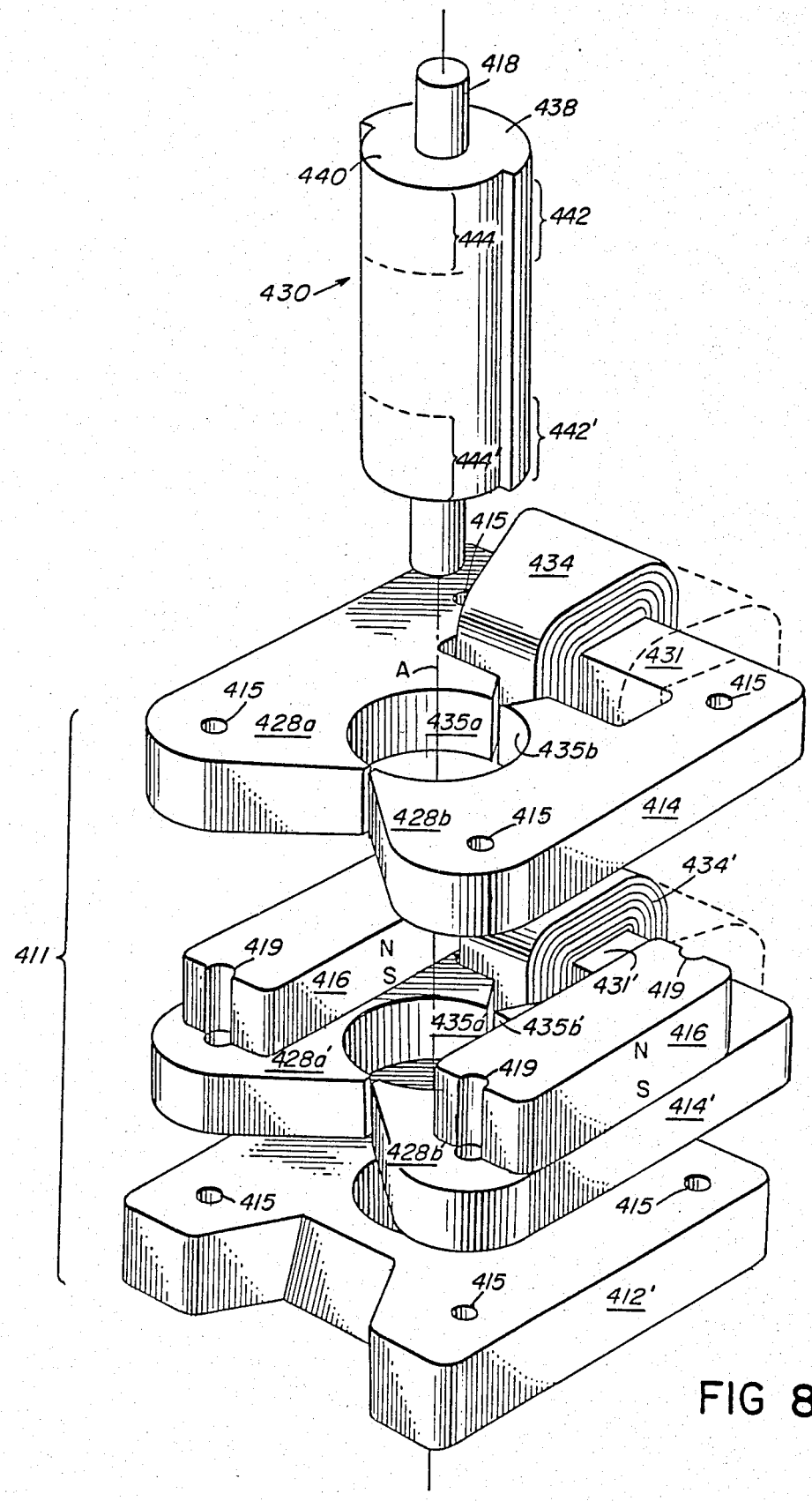

FIG. 8 is an exploded isometric view of the actuator of FIG. 7, with one end cap removed, the rotor assembly shown axially separated from the stator assembly, and the coils shown cut away.

FIG. 9 is a sectional side view (at section 9—9 of FIG. 7) of the actuator of FIG. 7.

Figure 10:
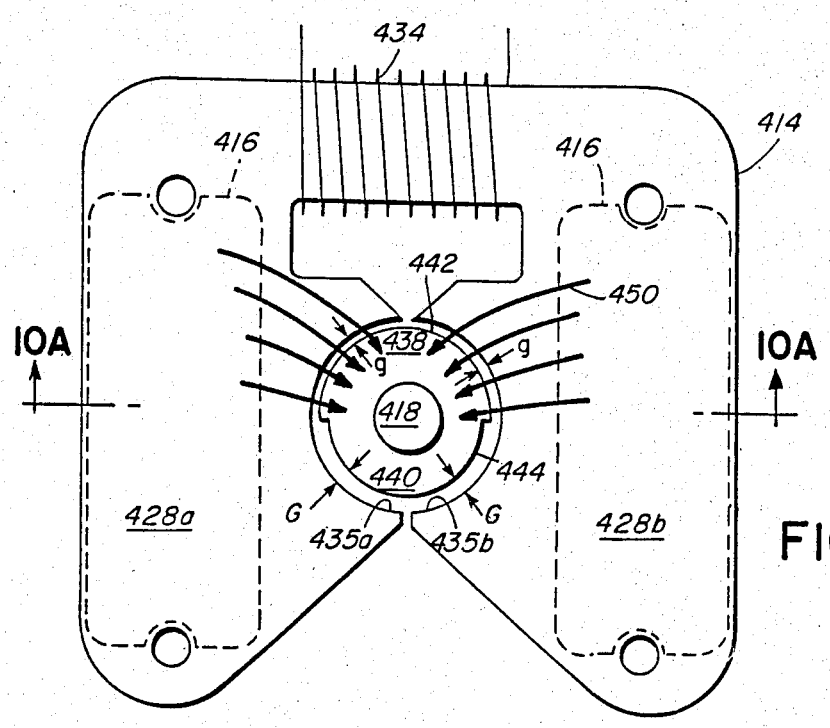

FIG. 10 is a top view of the actuator of FIG. 7 (with the end caps removed and the coil shown diagrammatically), showing representative bias flux paths for the rotor in its central position.

Figure 10A:
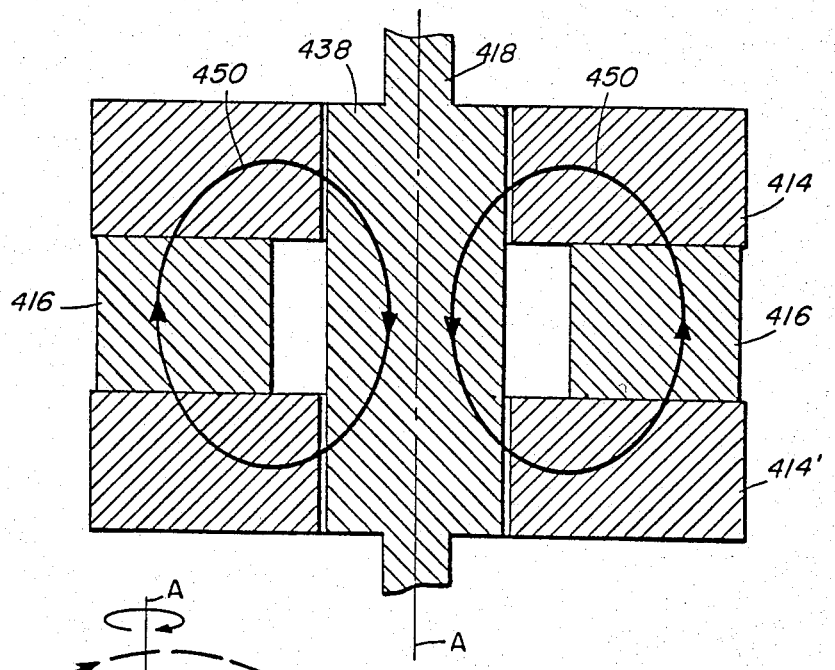

FIG. 10A is a sectional side view (at section 10A—10A in FIG. 10) of the actuator of FIG. 1, showing representative bias flux paths.

Figure 10B:
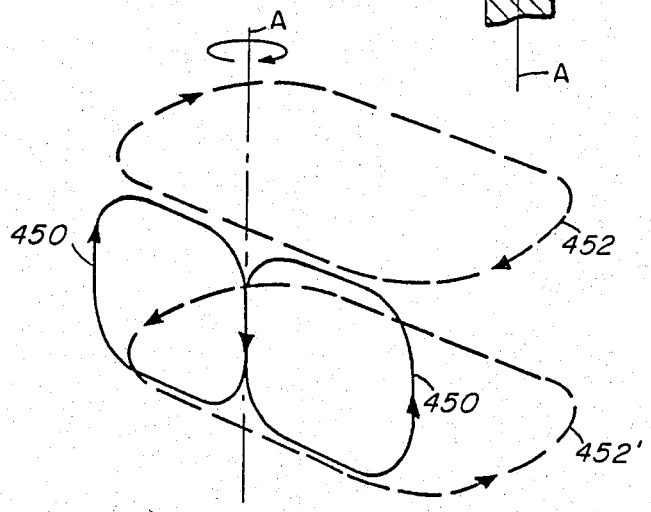

FIG. 10B is an isometric view of representative bias flux paths and control flux paths corresponding to the actuator of FIG. 10.

Figure 11:
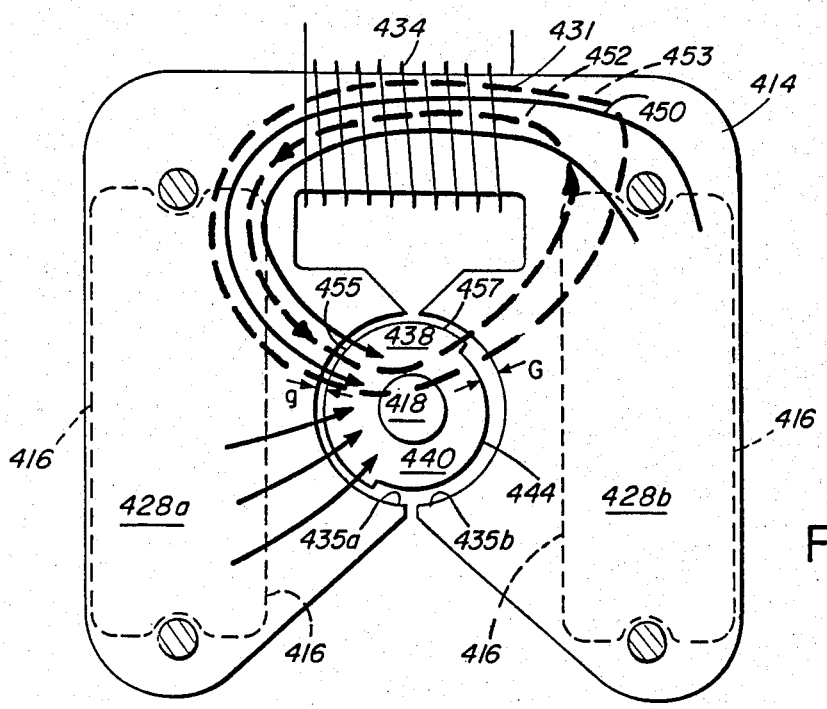

FIG. 11 is a top view of the actuator of FIG. 7 (with the end caps removed and the coil shown diagrammatically), showing representative bias flux paths for the rotor near its furthest angular excursion in the counterclockwise direction.

Figure 11A:
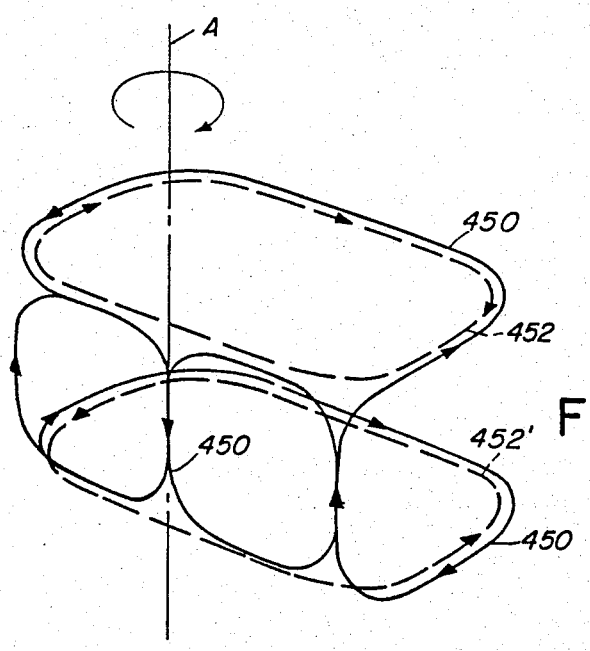

FIG. 11A is an isometric view of representative bias flux paths and control flux paths corresponding to the actuator of FIG. 11.

Figure 12:
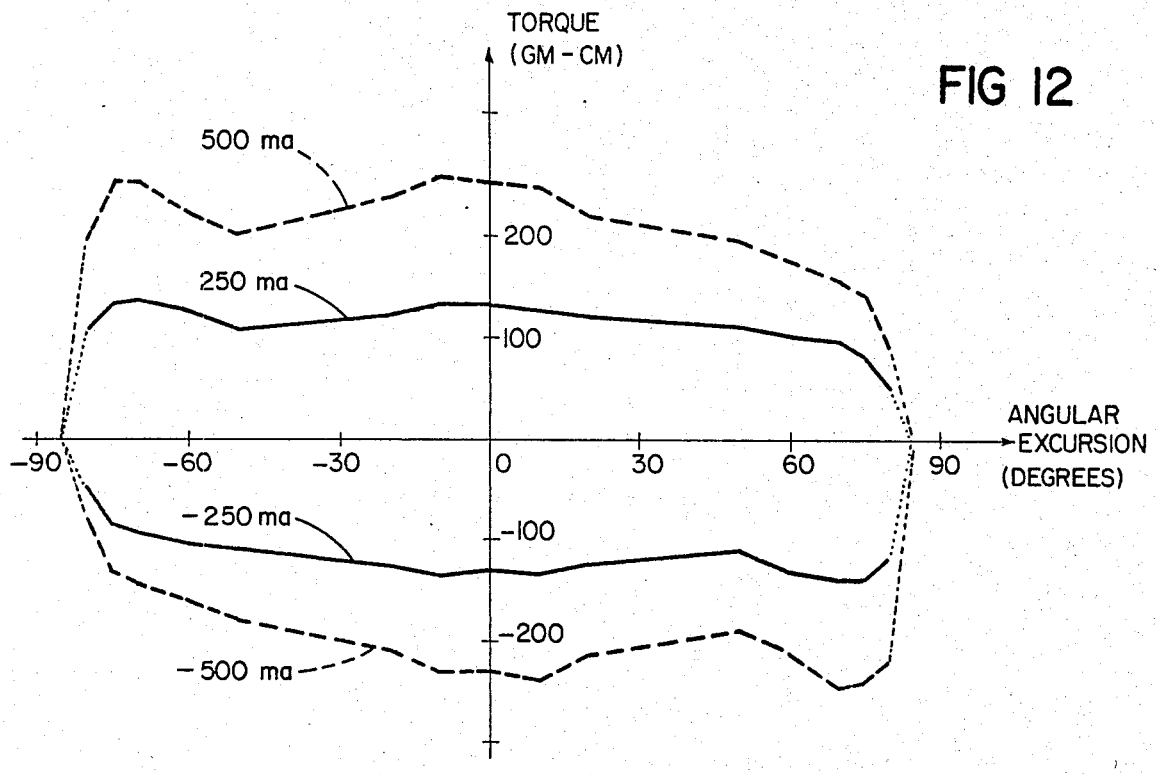

FIG. 12 graphs torque against angular position for various drive currents for the actuator of FIG. 7.

Figure 13:
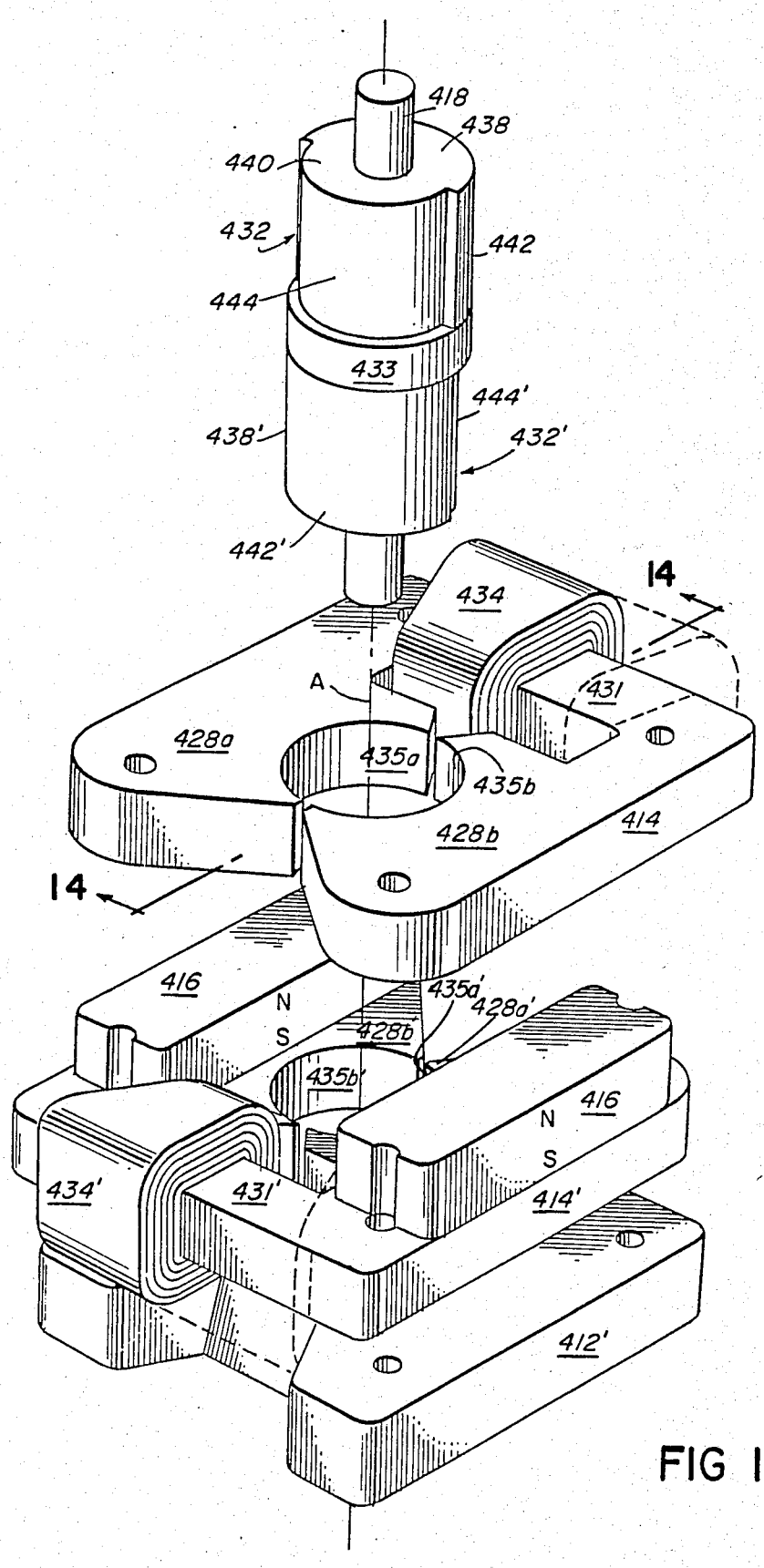

FIG. 13 is an exploded isometric view of another embodiment of the actuator, with one end cap removed, the rotor assembly shown axially separated from the stator assembly, and the coils shown cut away.

Figure 14:
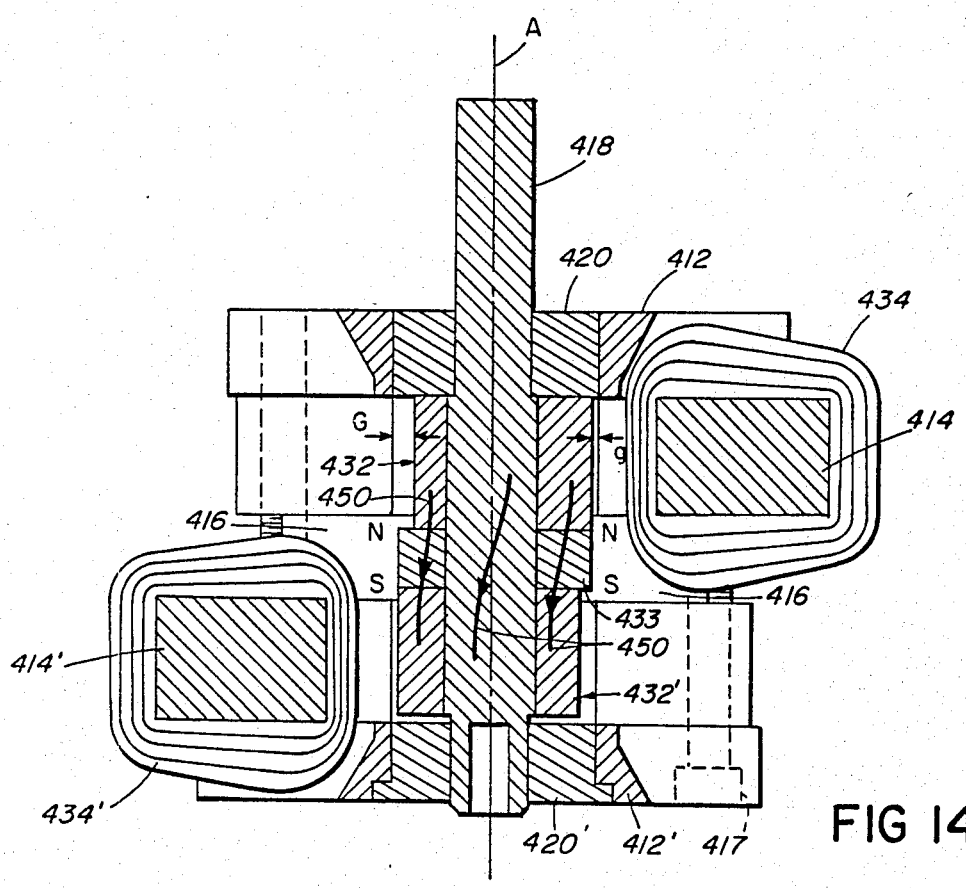

FIG. 14 is a sectional side view (at section 14—14 of FIG. 13) of the actuator of FIG. 13.

STRUCTURE AND OPERATION

Referring to FIG. 1, and actuator 20 has two stator pole pieces 22, 24 located on opposite sides of rotational axis 26 and joined by a pair of permanent magnets 28, 30. Stator pole piece 22 defines a pair of cylindrical stator pole faces 34, 36, while stator pole piece 24 defines a pair of cylindrical stator pole faces 38, 40 (all having the same radius). Drive coils 39, 41 are respectively wound around stator pole pieces 22, 24. A rotor 42 is arranged to rotate relative to stator pole pieces 22, 24, in an operational range between two positions of maximum angular excursion (FIG. 1 shows rotor 42 in the neutral center position). Rotor 42 defines two primary rotor pole faces 44, 46, each of which overlaps two of the stator pole faces, and each of which has an extent on the same order as the extent of each stator pole face. The term gap refers to the separation between the pole faces, and the term extent refers to the arc length of the pole face about the axis of rotation.

Figure 2:
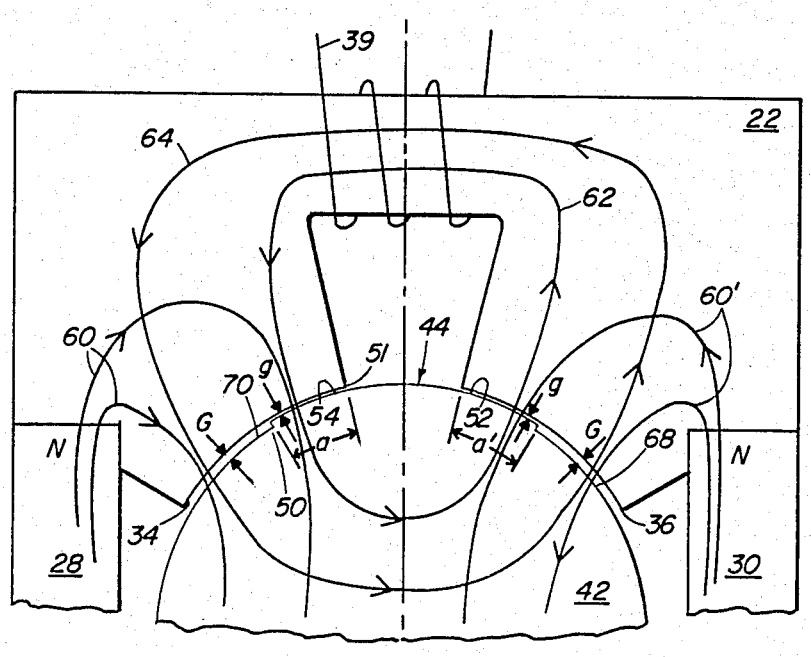
FIG. 2 is an enlarged partial front view of the actuator of FIG. 1 with the rotor in its central position and the gaps between the rotor and stator not shown to scale.

Referring to FIG. 2 (which shows only the upper half of the actuator of FIG. 2, the lower half being identical to the upper half), the maximum angular excursion of rotor 42 in one direction is defined by the angle a, which represents how far rotor 42 can turn clockwise until the end 50 of rotor pole face 44 reaches the end 51 of stator pole face 34, and likewise the maximum counterclockwise angular excursion in the other direction is defined by a like angle a'. The actual operational range may be somewhat less than the maximum possible excursion. Main rotor pole face 44 has first and second rotor pole face regions 52, 54 which lie respectively opposite stator pole faces 36, 34, from which they are spaced by a uniform driving gap g. Secondary rotor pole face regions 68, 70 lie respectively opposite stator pole faces 36, 34, from which they are spaced by a larger uniform flux-transmitting, compensating gap G. Gap G, being larger, is less permeable than gap g.

Magnetic bias flux follows paths 60, 60' (of which two representive flux lines are shown) in the same direction from magnets 28, 30 across gaps g and G and through rotor 42, returning via rotor pole face 46 (FIG. 1). The ratio of the permanent magnet fields in gaps G to the permanent magnet fields in gaps g is g/G, the fields in gaps G thus being smaller.

Drive flux from coil 39 can follow both a primary path 62 and a secondary path 64 (of which only representative flux path lines are shown). The primary path 62 passes through stator pole face 34, across gap g, through rotor pole face region 54, through rotor 42, through rotor pole face region 52, across gap g, and returns again to coil 39.

The secondary path 64 passes through stator pole face 34, across gap G, through rotor pole face region 70, through rotor 42, through rotor pole face region 68, across gap G, through stator pole face 36, and returns again to coil 39.

While rotor 42 occupies positions near the neutral position shown in FIG. 2, almost all of the drive flux can follow path 62 because the areas of rotor pole face regions 52, 54 which overlap the stator pole face regions 36, 34, are relatively large.

To impose a torque on the rotor (and thereby move it in a desired direction), a current is applied to the drive coils, which establishes the drive flux paths through the stator and rotor. In FIG. 2, drive flux flows along paths 62, 64 only in one of the stator pole pieces (22) and imposes a torque on the corresponding rotor segment. Drive flux also flows along other flux path lines (not shown) in response to drive coil 41 (FIG. 1). Flux on path 62 reinforces the bias flux on path 60 passing across the gap at rotor pole face region 54 and opposes the bias flux on path 60' passing across the gap at rotor pole face region 52. As a result, a torque will be imposed on rotor 41 tending to turn it in the direction which will cause an increase in aggregate flux across the two gaps.

A torque can be imposed in the opposite direction by reversing the direction of the current through the coils.

As rotor 42 moves to different angular positions, the areas of rotor pole face regions 52, 54 will change.

The size of the torque created by the current in the coils of a conventional actuator can be shown to be determined by the following equation:

$$T=BLNID-mDL(NI)^2/2g*c/a$$

where

B=magnetic field in the gaps between the rotor and stator induced by biasing magnets L=thickness of each pole piece N=number of wire turns on each control coil I=current in each control coil D=diameter of rotor m=the permeability of air C=the angular position for which the torque is calculated a=the maximum possible angular excursion from the center position g=the air gap Thus the torque has a first term (BLNID) which varies linearly with current and a secondary nonlinear term which varies with the angular excursion and with the square of the current.

The cause of the nonlinearity can be explained as follows. With the rotor of a conventional actuator (FIG. 3 without gaps G) near one position of maximum angular excursion, the path 62 for the drive flux produced by the drive coil 39 is through stator pole face 34, across gap g, through region 54 of the rotor pole face, through a second region 52 of the rotor pole face, across gap g, through stator pole face 36 and back to coil 39. As indicated in FIG. 3, the area of region 54 approaches zero at the position of maximum angular excursion producing an increased reluctance, which effectively chokes off flux path 62, causing the nonlinearity of torque.

The effect of such nonlinearity in conventional actuators is to produce a situation in which, at wide angular excursions, the magnitudes of drive current needed to produce a given torque at such a position differ for clockwise and counterclockwise movements. For example, FIG. 3 shows the drive flux path 62 reinforcing the permanent magnet flux 60 at pole face region 54 and thus tending to rotate the rotor counterclockwise. But the area of region 54 is so small that the flux on path 62 is choked off and the resulting torque is not as great as expected. By contrast, if the drive current were reversed in sign (but held at the same magnitude), the drive flux paths would reverse directions. Now, drive flux 62 would reinforce permanent magnet flux 60' and tend to rotate the rotor clockwise. Since the area of pole face region 52 is large enough to handle the flux, the torque on the rotor is not reduced. Thus, for a given level of current, the clockwise torque exceeds the conterclockwise torque, a discrepancy which grows large at wide angular excursions, and produces instability when a positive feedback servo control is used to control rotor motion at high speeds.

Figure 3:
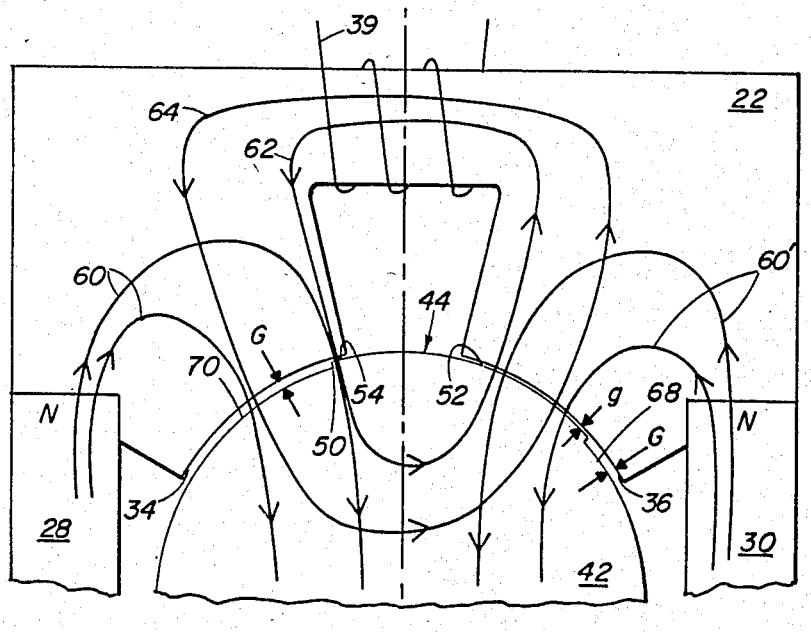
FIG. 3 is an enlarged partial front view of the actuator of FIG. 1 with the rotor positioned near its maximum excursion in one direction and the gaps between the rotor and stator not shown to scale.

The invention reduces the nonlinearity by providing the secondary path 64 of FIG. 3 for the drive flux via secondary rotor pole face regions 68, 70. The reluctance thus converges to a finite value at the maximum angular excursion, the magnetic fields never go to zero, and choking off of the drive flux is reduced. Note that the total area of gaps g, and the total area of gaps G, as seen by permanent magnets 28, 30 are respectively constant as rotor 42 turns.

The choking off of the drive flux in the absence of a secondary path can be understood as follows. The coil generated magnetic field across gap g via rotor pole face region 54 can be expressed as $$B_1=mNI/g*A_2/A$$

where $A_1$ and $A_2$ are the areas of pole face regions 54 and 52. Because of the configuration of the rotor and stator, the sum of these areas ($A=A_1+A_2$) is a constant and they can be expressed as the following functions of angular excursion $$A_1=Lr(a-c)$$

$$A_2=Lr(a+c)$$

$$A=2Lra$$

where r is the radius of the pole face. Thus $$B_1=mNI/g*(a+c)/2a$$

Likewise, $B_2$, the coil generated magnetic field across gap g via rotor pole face region 52 can be expressed as $$B_2=mNI/g*(a-c)/2a$$

Thus $B_1$ converges to zero as the rotor approaches the maximum angular excursion. And because $B_2$ is limited by $B_1$, $B_2$ also converges to zero.

By contrast in the actuator of FIG. 3, with the secondary rotor pole regions included, the reluctance in the gap at region 52 converges to a finite value, and magnetic fields $B_1$ and $B_2$ never go to zero, instead having a limit value expressed as $$mNI/g*1/(1+G/g).$$

It can be seen that if gap G equaled the value g, the magnetic field could no longer be a function of excursion nor would be the energy in the gaps g, G, and therefore it would not be possible to generate a torque. Thus, a value for G greater than g is necessary. In general, smaller values of G give better linearity at a cost of less efficiency in terms of torque for a given electrical power level. Larger values of G give poorer linearity but have better efficiency. Experimental results indicate that in many circumstances results are obtained when compensating gaps G are 4 to 15 times (most preferably 7 to 8 times) the dimension of primary driving gaps g.

The presence of the additional drive flux path necessitates enlarged permanent magnets as well as flux paths with larger sections. Also, the null peak torque will be less for this new design and the inductance will be higher.

Referring to FIG. 4, the curves of measured torque versus the ratio of actual excursion to maximum excursion were as shown for drive currents of 1.0 amp. and 0.5 amp. (all motors having 0.500 diameter bore, g=0.004 inches, G=0.040 inches, and 200 turns per drive coil) reflecting good linearity over a wide range of angular excursions. Current curves 102 and 104 represent actuators in which the rotor, unlike the actuator of FIG. 1, does not have additional pole face regions. Current curves 106, 108, and 110, 112, represent respectively two actuators of the kind shown in FIG. 1, driven by 1.0 amp and 0.5 amp drive currents. The actuator represented by curves 106, 108 had a nominal maximum angular excursion of 50° while the actuator represented by curves 110, 112 had a nominal maximum angular excursion of 45°.

Referring to FIG. 5, controlled current source 236 typically includes a source of position command signals 272, a rotor position sensor 274, and a suitable feedback circuit 276. The feedback circuit, in a known manner, regulates the control current 278 in accordance with errors between actual and desired positions, thus to enable the rotor to accurately follow the command signals in a suitably damped manner. (Details of one possible control circuit are set forth in U.S. Pat. No. 4,142,144, Rohr, Feb. 27, 1979, assigned to the same assignee as this application and hereby incorporated by reference.)

The invention has application wherever high torque and high positional accuracy is required over a broad range of angular excursions. This is commonly the goal of high-speed position servo systems.

For example, referring to FIG. 6, a rotating optical storage disk 312 can be scanned by an optical element 322 mounted on a rotating arm 320 attached to a shaft 318 connected to the rotor of actuator 20. Information stored in concentric tracks on disk 312 can be rapidly (e.g., with a 2 or 3 millisecond response time) and accurately retrieved by precise rotation of actuator 20, under feedback control, which is made possible by the improved rotor arrangement of the invention. The effect of the new rotor arrangement is to assure that, regardless of the starting position of element 322, a given current applied to actuator 20 will accomplish the same angular displacement in the same amount of time.

The actuator is also useful in many other applications, including strip chart recorder and optical scanning systems.

OTHER EMBODIMENTS

Other embodiments are within the following claims.

For example, referring to FIGS. 7 and 8, actuator 410 has a stator assembly 411 including two end caps 412, 412', between which are stacked, along axis A, two pole pieces 414, 414' and (between the pole pieces) two permanent magnets 416. The stator assembly is held together by four assembly screws 417. Rotor shaft 418 (preferably ferromagnetic) is journaled in a pair of bearings 420, 420' (420' being hidden in FIG. 7) which are respectively held in end caps 412, 412'.

Referring to FIGS. 8, 9, ¾" long ferromagnetic rotor 430 (force fitted onto shaft 418) has two semi-cylindrical sections of different diameters 438, 440. The curved outer surface of the larger diameter (e.g., 0.610" diameter) semi-cylindrical section 438 defines two rotor pole faces 442, 442' (hidden in FIG. 8) and the curved outer surface of the smaller diameter (e.g., 0.500" diameter) semi-cylindrical section 440 similarly defines two relief areas (secondary rotor pole face regions) 444, 444'.

Stator assembly 411 has two identically-shaped, flat ferromagnetic pole pieces 414, 414', spaced apart along axis A, positioned parallel to one another and perpendicular to axis A, and separated by two rectangular sintered alnico biasing magnets 416 which generate a bias field. Each magnet is approximately 1.4 inches long, 0.62 inches wide and 0.25 inches thick and has a north pole face in flux-conducting contact with a flat axially directed surface of one of the pole pieces and a corresponding south pole face in flux-conducting contact with a flat axially-directed surface of the other pole piece.

Each pole piece 414, 414' is approximately 2 inches square and 0.375 inches thick and has two legs **428*a*, 428*b*; 428*a'*, 428*b'*, respectively, joined at one end by a respective highly permeable connecting segment 431, 431'. The two legs of each pole piece are shaped to form two almost semi-circular (e.g., subtending 160° around axis A) stator pole faces 435*a*, 435*b*; 435*a'*, 435*b'* which are directed toward one another to define a 0.625" diameter round opening. The connecting segment of each pole piece is wrapped by a 600-turn insulated-wire control (drive) coil 434, 434' for carrying a current of 0.5 amps. The two control coils are connected in series and then to a controlled source of variable current 436**.

The two pole pieces are positioned with their connecting segments on the same side of axis A, with the round openings in the two pole pieces in line to receive the rotor assembly. The rotor pole faces 442, 442' have a slightly smaller diameter than stator pole faces **435*a*, 435*b*, 435*a'*, 435*b'* for rotating clearance. When the actuator is assembled, the rotor is held in a fixed axial position by bearings 420, 420' and can rotate freely. Each rotor pole face (e.g., upper rotor pole face 442) bridges the corresponding two stator pole faces (e.g., upper stator pole faces 435*a*, 435*b*) in all positions within the wide angular excursion of the rotor. The radial gaps g between each rotor pole face and each of the corresponding two stator pole faces are small enough (e.g., about 0.008") to provide low reluctance magnetic flux paths across those gaps, while the radial gaps G between relief areas (secondary pole face regions) 444, 444' and the corresponding pole faces 435*a*, 435*b*; 435*a'*, 435*b'*** are large enough (e.g., about 0.063") to limit to a low value (relative to gaps g) the flow of permanent magnet flux across those spaces. The difference in radii between the two sections of the rotor is such that G is about eight times the gap g between the stator and rotor pole faces.

Each pole piece has four assembly holes 415 and the ends of the magnets have retaining slots 419, the holes and slots being arranged to receive bolts to hold the pole pieces and magnets rigidly in place. The magnets are sufficiently thick to separate the pole pieces by a space which prevents coils 434, 434' from touching each other.

End caps 412, 412' (cast or machined aluminum or sintered non-magnetic stainless steel) are 0.250 inches thick, 2 inches long and 1.8 inches wide. Both end caps have a 0.625" center hole for mounting a bearing 420, 420' and four holes 415 for screws 417. The four holes in end cap 412 are tapped to receive the threaded ends of the screws and the four holes in end cap 412' are countersunk to receive the screw heads.

The actuator is manufactured inexpensively by using sintered magnets (ground only on the two surfaces which contact the pole pieces), stamped metal pole pieces, die cast end caps, and extrusions for the rotor segments. The parts are easily assembled using a simple mandrel. Alignment is simplified (as compared with conventional actuator) because each pole piece is an integral part having an almost full circular hole, the bounding surfaces of which can contact and be accurately aligned by the mandrel. The other dimensions of the magnets need not be precisely machined because small differences in their dimensions will not affect the size of the gaps g between the rotor pole faces and the stator pole faces.

The biasing magnets establish a continuous biasing flux flow through the stator and rotor assemblies whose path through the rotor is always axial but whose path through the pole pieces depends on the angular orientation of the rotor.

Referring to FIGS. 10, 10A, and 10B, when the rotor is oriented in its central position as shown (i.e., with each rotor pole face 442, 442' spanning equal portions of its corresponding two stator pole faces), the biasing flux 450 flows from the north pole of magnets 416 inwardly across legs 428*a*, 428*b* of pole piece 414 toward the rotor, across gaps g between the stator pole faces and the rotor pole face 442 into the upper end of the rotor, axially in the rotor into the lower end of the rotor, outwardly across gaps g between the pole faces 442' of the lower rotor segment and the stator pole faces 435*a'*, 435*b'* of the lower pole piece, outwardly across legs 428*a'*, 428*b'*, and inwardly into the south poles of the magnets.

When the rotor is positioned at an angle to the central position, each pole face 442, 442' has a greater area of exposure to one of the corresponding stator pole faces than to the other, so that for each pole face 442, 442' more of the biasing flux can cross the gap g at one of its corresponding stator pole faces than the other. The connecting segment 431, 431' of each stator pole piece provides a path for the excess biasing flux.

Thus, referring to FIGS. 11 and 11A, with the rotor positioned near its greatest angle of rotation away from the central position, most of the biasing flux paths 450 must pass through the connecting segments of the pole pieces, although a small part of the flux continues to follow a path similar to the path followed in the case of the central position.

Regardless of the position of the rotor, the biasing flux on path 450 always passes axially through the rotor, and (when the rotor is not in the central position) some flux passes through the connecting segments. In the absence of a control current in the control coils 434, 434', no torque is imposed on the rotor, regardless of the rotor position. Torque can be defined as the change in the total magnetic energy in the four gaps (defined between the two pole faces 442, 442' and their corresponding stator pole faces 435*a*, 435*b*, 435*a'*, 435*b'*) as the rotor tends to turn. Because the total volume in the four gaps and the total magnetic field in the gaps would remain unchanged with movement of the rotor, to torque would be induced, hence the rotor has no preferential position.

To impose a torque on the rotor (and thereby move it in a desired direction), a current is applied to the control coils, which establishes a pair of control flux paths 452, 452' (shown in FIGS. 10B, 11A). Each control drive flux path flows only in one of the stator pole pieces and imposes a torque on the corresponding rotor segment. Because of the directions of flow of the two control flux paths, the torques on the two segments reinforce each other. Thus, with the current flowing in a particular direction in control coil 434, control flux along path 452 circulates in pole piece 414 through connecting segment 431 and leg 428*b*, across the gap between stator pole face 435*b* and rotor pole face 442, across section 438 of rotor 430, across the gap between stator pole face 435*a* and rotor pole face 442, and through leg 428*a* back to connecting segment 431. (Flux line 452' takes a similar path (but in the opposite direction) through pole piece 414' and rotor segment 438'). Flux on path 452 reinforces the bias flux on path 450 passing across the gap between pole faces 435*b*, 442 and opposes the bias flux on path 450 passing cross the gap between pole faces 435*a*, 442. As a result, a torque will be imposed on rotor 430 at pole face 442 tending to turn the rotor in the direction which will cause an increase in aggregate flux across the two gaps (in this case clockwise).

At the same time, flux path 452' takes a similar course through pole piece 414' and rotor segment 438, except in the opposite direction, which is accomplished by arranging the current to flow in the appropriate direction through control coils 434'. The torque imposed by coil 434' is also clockwise, reinforcing the torque imposed by coil 434.

A counterclockwise torque can be imposed in an analogous manner by reversing the direction of the current through the coils.

Referring again to FIG. 11, the provision of a compensating pole face 444 on rotor 418 provides a secondary flux path 453 (in addition to the main flux path 452 across main pole face regions 455, 457), so that at rotor positions near the maximum angle excursion, the drive flux is not choked off, thus improving linearity.

Referring to FIG. 12 with the resistance of the two drive coils in series being 26 ohms, and their inductance being 161 millihenries at 120 Hz and 88 millihenries at 1K Hz, the torque versus drive current curves were as shown for drive currents of 250, 500, −250, and −500 milliamps, reflecting good linearity over a wide range of angular excursions.

Referring to FIGS. 13, 14, in other embodiments, segments 432, 432' can be mounted on shaft 418 so that rotor pole faces 442, 442' are on opposite sides of axis A, and pole pieces 414, 414' then can be assembled with their connecting segments 431, 431' and coils 434, 434' on opposite sides of axis A. This arrangement permits pole pieces 414, 414' to be mounted closer together because coils 434, 434' do not encroach on each other's space. Ring-shaped segment 433, having a thickness of at least ½ the difference in diameters between pole faces 442 and 444, assures better bias flux flow between segments 438, 438', as illustrated by flux paths 450 in FIG. 14. (Ring-shaped segment 433 could alternatively be eliminated).

What is claimed is:

1. In an actuator comprising a stator assembly which defines a pair of stator pole faces, a permeable rotor assembly which is positioned to rotate relative to the stator assembly, and which defines a driving pole face separated from each of the stator pole faces by a flux permeable driving gap, the rotor assembly having an operational range of rotor angular positions over which drive flux passing across the driving gap drives the rotor assembly, the extent of the driving gap at one of the stator pole faces being reduced as the rotor assembly rotates toward the limit of the operational range, the improvement comprising a flux-permeable compensating gap between the driving pole face and each stator pole face which provides a secondary path for drive flux as the rotor assembly rotates toward the limit of the operational range, the compensating gap being less permeable than the driving gap.

2. The improvement of claim 1 wherein the compensating gap at each stator pole face increases in extent as the driving gap at that stator pole face decreases, and vice versa.

3. In an actuator comprising a stator assembly, a permeable rotor assembly positioned to rotate, relative to the stator assembly, between two opposite positions of maximum operational angular excursion, the stator assembly defining first and second stator pole faces arranged around the rotational axis of the rotor assembly, the rotor assembly defining a main rotor pole face separated from the first and second stator pole faces by a uniform gap g, the extent of the main rotor pole face relative to the extent of the stator pole faces being such that at positions close to each position of maximum angular excursion, the overlap between the rotor pole face and one of the stator pole faces converges to zero, the improvement in which the rotor assembly further defines secondary pole face regions adjacent either end of the main pole face, the secondary regions being separated from the stator pole faces by uniform compensating gaps G, where G is greater than, but no more than about 15 times greater than g.

4. The improvement of claim 1 wherein the rotor assembly defines a rotor pole face which is separated from the two stator pole faces respectively by first and second driving gaps, and is arranged to define variable first and second pole face regions which overlap and cooperate respectively with the two stator pole faces, the areas of the first and second regions being dependent on the angular position of the rotor assembly, the areas being reduced respectively at the opposite limits of the operational range, a drive means is associated with the stator assembly and is arranged to impose a variable magnetic driving flux along a path which passes through one stator pole face, across the first driving gap, through the first region of the rotor pole face, through the second region of the rotor pole face, and through the other stator pole face, and the rotor assembly further defines secondary pole face regions separated from the two stator pole faces by the compensating gap and arranged to overlap and cooperate with the two stator pole faces to provide the secondary path for the magnetic driving flux to pass between the rotor assembly and at least one of the stator pole faces.

5. The improvement of claim 4 wherein, the stator assembly further defines third and fourth stator pole faces arranged around the rotational axis of the rotor assembly, the rotor assembly further defines an additional rotor pole face which is separated from the third and fourth stator pole faces respectively by third and fourth flux-permeable driving caps, and is arranged to define variable third and fourth pole face regions which overlap and cooperate respectively with the third and fourth stator pole faces, the areas of the third and fourth regions being dependent on the angular positon of the rotor assembly, the areas converging to zero respectively at the two points of maximum excursion, the drive means is further arranged to impose an additional variable magnetic driving flux along an additional path which passes through the third stator pole face, across the third driving gap, through the third region of the additional rotor pole face, through the fourth region of the additional rotor pole face, and through the fourth stator pole face, and the rotor assembly further defines additional secondary pole face regions separated from the third and fourth stator pole faces by an additional flux-permeable compensating gap and arranged to overlap and cooperate with the third and fourth stator pole faces to provide an additional secondary path for the magnetic driving flux to pass between the rotor assembly and at least one of the stator pole faces.

6. The improvement of claim 1 or 3 wherein the pole faces are cylindrical.

7. The improvement of claim 4 wherein the stator pole faces are cylindrical and have the same radius, the pole face regions are cylindrical and have the same radius, and the secondary pole face regions are cylindrical and have the same radius.

8. The improvement of claim 7 wherein the driving gaps are uniform and equal to g, and the compensating gaps are uniform and equal to G.

9. The improvement of claim 3 or 8 wherein G is between about 4 and about 15 times (preferably between about 7 and 8 times) greater than g.

10. The improvement of claim 3 or 4 wherein the first and second stator pole faces and the secondary pole face regions are contoured to provide a selectable relationship between drive current and rotor torque.

11. The improvement of claim 3 or 8 wherein g is about 0.004 inches and G is about 0.040 inches.

12. The improvement of claim 3 or 4 wherein the rotor assembly defines a pair of rotor pole faces spaced apart along the rotational axis and permeably connected by a flux path having an axial component through the rotor assembly, and, each rotor and stator pole face subtends an angle of between about 90° and about 180° around the axis.

13. The improvement of claim 12 wherein each rotor pole face subtends an angle of approximately 180°.

14. The improvement of claim 12 wherein each stator pole face subtends an angle between about 120° and about 160°.

15. The improvement of claim 4 wherein the extent of each secondary pole face region is of the same order as the extent of each stator pole face.

16. The improvement of claim 4 further comprising an optical medium for storing information, an optical element for sensing information stored on the medium, and an arm for supporting the optical element, the arm being connected at a point spaced from the optical element to the optical element to move to selectable positions with reference to the optical medium.

* * * * *

UNITED STATES PATENT AND TRADEMARK OFFICE

CERTIFICATE OF CORRECTION

PATENT NO. : 4,528,533

DATED : July 9, 1985

INVENTOR(S) : Jean I. Montagu

It is certified that error appears in the above-identified patent and that said Letters Patent are hereby corrected as shown below:

Col. 4, line 11, "and" should be --an--;

Col. 9, line 66, "to torque" should be --no torque--;

Col. 12, line 10, "driving caps" should be --driving gaps--.

Signed and Sealed this

*Twenty-first* Day of *January 1986*

[SEAL]

*Attest:*

DONALD J. QUIGG

*Attesting Officer*

*Commissioner of Patents and Trademarks*